United States Patent [19]

Iyama et al.

[11] 4,303,229

[45] Dec. 1, 1981

[54] MECHANICAL PUNCHING DEVICE FOR PUNCHING THE TUYERES OF A CONVERTER

[75] Inventors: Yukio Iyama; Masao Fujita; Nobuhiro Higashiiriki, all of Oita, Japan

[73] Assignee: Nippon Mining Company Limited, Tokyo, Japan

[21] Appl. No.: 169,551

[22] Filed: Jul. 17, 1980

[30] Foreign Application Priority Data

Jul. 23, 1979 [JP] Japan ..... 54-92666

[51] Int. Cl.[3] ..... C21C 5/46

[52] U.S. Cl. ..... 266/135; 266/271

[58] Field of Search ..... 266/45, 47, 135, 136, 266/269, 271-273, 287

[56] References Cited

U.S. PATENT DOCUMENTS

| | | | |
|---|---|---|---|
| 2,008,795 | 7/1935 | Olmstead | 266/136 |
| 2,425,792 | 8/1947 | Forbes | 266/136 |
| 3,667,748 | 6/1972 | Dienenthal et al. | 266/273 |
| 4,202,536 | 5/1980 | Demidowicz et al. | 266/135 |
| 4,265,433 | 5/1981 | Kubo | 266/273 |

*Primary Examiner*—Peter K. Skiff

*Attorney, Agent, or Firm*—Sughrue, Mion, Zinn, Macpeak and Seas

[57] ABSTRACT

A mechanical punching device for punching the tuyeres of a converter properly independently of the angle of inclination of the converter. Link mechanisms, each having two turning arms, are provided on both sides of a carriage with the two turning arms being connected together by the end shaft of the link drive device. The end shaft is a link drive device movable vertically so that the distance between one of the supporting shafts which serves as a fulcrum and one of the holding shafts of the mechanical puncher on the side of the punching rod is shorter than the distance between the other supporting shaft and the other holding shaft. The holding shafts slide along guide slots formed in the side wall of the carriage. The angle of inclination and horizontal and vertical positions of the mechanical puncher are thereby changed with a single operation of the link drive device.

4 Claims, 6 Drawing Figures

MECHANICAL PUNCHING DEVICE FOR PUNCHING THE TUYERES OF A CONVERTER

BACKGROUND OF THE INVENTION

The present invention relates to a mechanical puncher with which tuyeres, are punched suitably according to the angle of rotation of the converter.

Matte formed in a blast furnace, a reverberatory furnace or a flash furnace is transferred into a converter where it is converted into blister copper by an oxidation reaction using an air blowing operation. A copper converter customarily has the form of a cylinder whose axis lies horizontally. A number of air blowing nozzles or tuyeres, forty-eight in one example, aligned parallel to the axis of the cylinder are provided on the outer shell of the converter. Molten matte is supplied into the converter through an opening on the top of the converter. Iron and sulfur components contained in the molten matte are oxidized by the oxygen in the air blown thereinto into iron oxides and sulfurdioxide gas. Molten materials in the converter are solidified and form encrustations at inner tips of the tuyeres by a diabatically cooling the molten material with blowing air. In this case, it becomes difficult to supply sufficient amount of air into the converter, as a result of which the converting operation must be suspended, when the solidified encrustations has built up. Therefore, mechanical punching operation is carried out in order to remove the solidified encrustations frequently.

According to the operating conditions of the converter, the level A of molten matte in the converter may be changed to the level B as shown in FIG. 1. In this case, the converter must be rotated in order to maintain constant the distance between the end of the tuyere in the converter and the surface of the molten matte as a result of which the tuyere is displaced from the position $3_1$ to the position 3. Accordingly, in order to satisfactorily mechanically punch the tuyeres 3, it is necessary to change the angle of inclination $\alpha$ of the punching rod with respect to the horizontal line to the angle of inclination $\beta$ while it is also necessary to change the position a of the punching rod to the position b both in a horizontal direction and in a vertical direction.

As described above, it is necessary to change the position of the punching rod in conformance with the variations in vertical direction, horizontal direction and angle of inclination of the tuyeres. Accordingly, a mechanism for controlling the positional relationships between the punching rods and the tuyeres is unavoidably intricate.

A typical conventional mechanical punching device is shown in FIG. 2. Rails 16' are mounted on a stationary frame 14' to allow a movable frame 9' to be moved parallel to the line of tuyeres. The mechanical puncher is moved vertically and towards and away from the converter by moving a board 15' up and down the slope of the frame 14'. The angle of inclination of the punching rod 4' is controlled by the combination of a worm gear 10' and a worm wheel 7'. Accordingly, with the mechanical punching device, it is necessary to direct the punching rod to the aimed tuyere by separately or individually controlling the three factors, vertical direction, horizontal direction and angle of inclination of the punching rod. Thus, the required control operation is complex and can be performed by a skilled operator only.

Accordingly, an object of the invention is to provide a mechanical punching device for punching the tuyeres of a converter in which the position and inclination angle of the punching rods are set with a single operation in conformance with the position of the tuyeres of which the angle of inclination and the horizontal and vertical position are changed according to operational requirements of the converter.

SUMMARY OF THE INVENTION

Specific features of the invention reside in that link mechanism each having two turning arms are provided on both sides of a carriage with the two turning arms being connected together by the end of a link drive device and the end shaft of the link drive device is moved vertically so that the distance between one of the supporting shafts serving as fulcrum and one of the holding shafts of a mechanical puncher on the side of the punching rods is shorter than the distance between the other supporting shaft and the other holding shaft and the holding shafts are slid along guide slots formed in the side wall of the carriage whereby the angle of inclination and horizontal and vertical positions of the mechanical puncher and accordingly those of the punching rods are changed with a single operation of the link drive device.

DESCRIPTION OF THE PREFERRED EMBODIMENTS

The invention will be described with reference to FIGS. 3 through 6.

Figure 3:
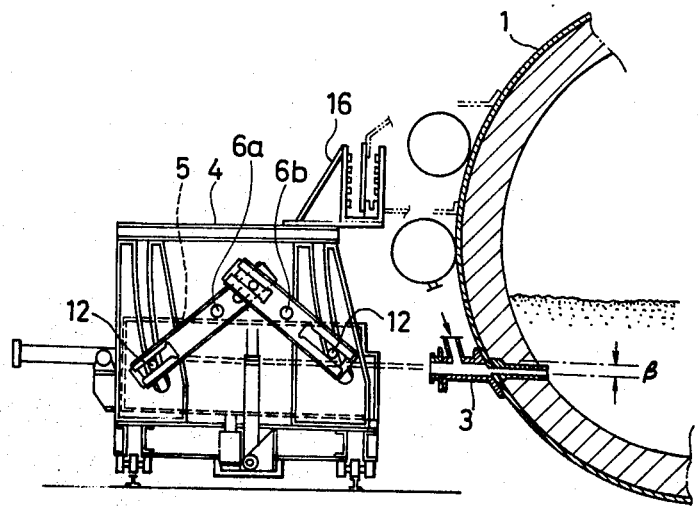
FIG. 3 is an explanatory diagram showing the positional relationships between a mechanical puncher on a carriage according to the invention shown as a side view and a tuyere of a converter shown as a sectional view.
Figure 5:
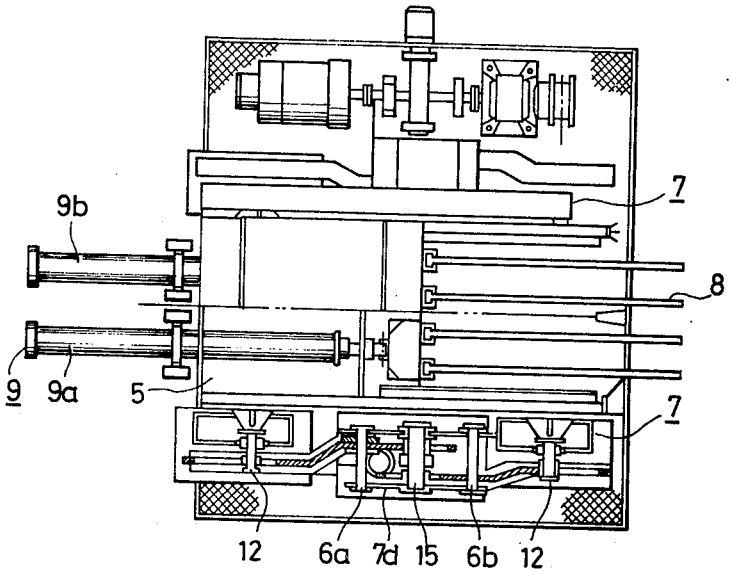
FIG. 5 is a plan view, partly in section, showing a mechanical puncher constructed according to the invention.
Figure 6:
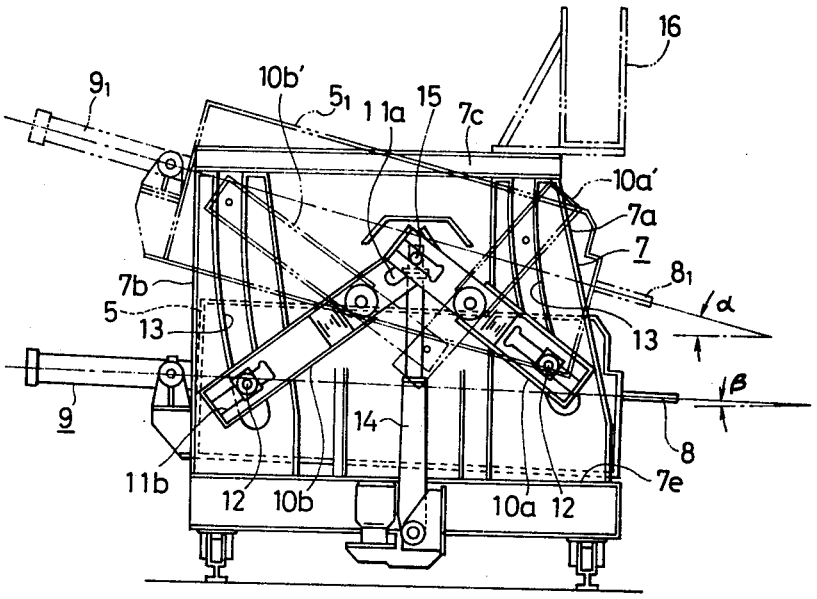
FIG. 6 is a side view of the mechanical puncher of FIG. 5.

FIG. 3 shows the positional relationships between the tuyeres 3 of a converter 1 and a carriage 4 constructed according to the invention. The carriage 4 together with a mechanical puncher provided thereon is moved on the rails which extend parallel to the axis of the converter 1. FIG. 5 is a plan view, partly in cross section, showing a mechanical puncher constructed according to the invention. FIG. 6 is a side view of the device shown in FIG. 5.

The carriage 4 is provided with two side walls each composed of plate-shaped supporting members *7a* and *7b*, a horizontal member *7c*, and a shaft supporting member *7d*. The members *7a*, *7b* and *7c* are connected together to form a frame assembly with the member *7d* extending upwardly from the bottom plate *7e* of the carriage and fixedly held in position. The mechanical puncher 5 is placed between the two side walls 7. Punching rods 8 are detachably secured at rear end portions to the front side of the mechanical puncher 5. Four such punching rods are shown in FIG. 5. The mechanical puncher 5 has two punching rod driving cylinders 9*a* and 9*b* to each of which two punching rods are coupled.

Figure 1:
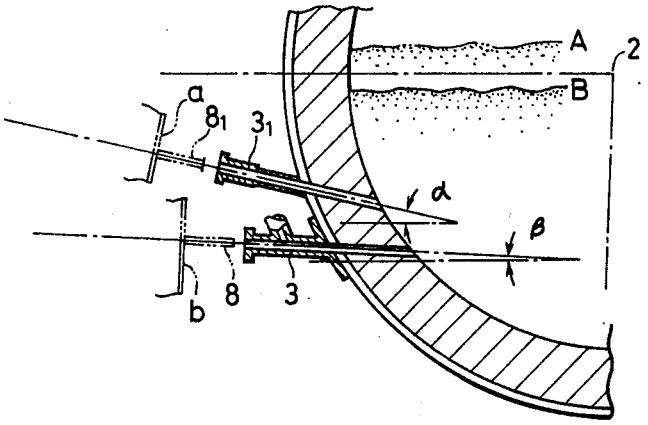
FIG. 1 is a sectional view showing the positional relationships between a tuyere of a converter and a punching rod in the case when the position of the tuyere is changed in accordance with operational requirements of the converter.
Figure 2:
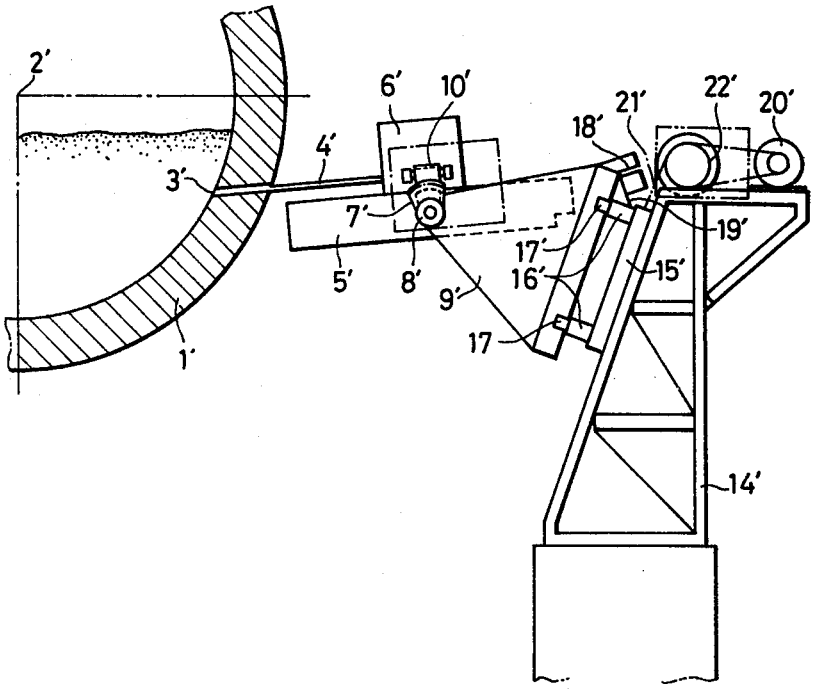
FIG. 2 PRIOR ART
FIG. 2 is a side view showing the construction of a prior art mechanical puncher.

A link mechanism is made up of a pair of turning arms 10*a* and 10*b* which are rotatably coupled to supporting shafts 6*a* and 6*b* provided on the side plate 7*d*. Bearing slots 11*a* and 11*b*, as shown in FIG. 6, are provided in both end portions of each of the turning arms. Holding shafts 12 provided for holding the mechanical puncher 5 pass through guide grooves 13 which are formed in the respective side plates and are slidably inserted into the bearing slots 11*b*. The guide grooves 13 provide arcuate curves each being concentrical with the converter shell. The end shaft 15 of a link drive device 14 is inserted into the bearing slots 11*a* of the turning arms 10*a* and 10*b* to connect the upper end portions of the arms 10*a* and 10*b* together so that the arms 10*a* and 10*b* can be displaced to the positions indicated at 10*a*' and 10*b*'. Accordingly, the mechanical puncher 5 can be displaced from the position indicated at 5 to the position indicated at $\mathbf{5}_1$ in FIG. 6 and at the same time the angle of inclination of the punching rod 8 with respect to the horizontal is changed from an angle $\beta$ of about 2° to an angle $\alpha$ of about 13° while the punching rod 8 is displaced to the position indicated at $\mathbf{8}_1$. That is, the punching rod 8 is moved towards the carriage in a horizontal direction and is displaced in a vertical direction. Thus, the positional relationships between the end of the tuyere and the end of the punching rod are as indicated in FIG. 1. In other words, by a single operation of the link drive device 14, the distance between the end of the punching rod 8 and the tuyere is set to the desired value, the angle of inclination of the mechanical puncher and accordingly of the punching rod is changed from $\beta$ to $\alpha$, and the axis of the tuyere is brought into an alignment with that of the punching rod. Furthermore, as the guide grooves 13 in the side walls are inclined towards the punching rod driving cylinders 9 (to the left in FIG. 6), the mechanical puncher 5 is moved backwardly (to the left in FIG. 6) or forwardly (to the right in FIG. 6) by operation of the link drive device whereby the positional relationships between the end of the punching rod and the end of the tuyere in FIG. 1 are suitably maintained.

Figure 4:
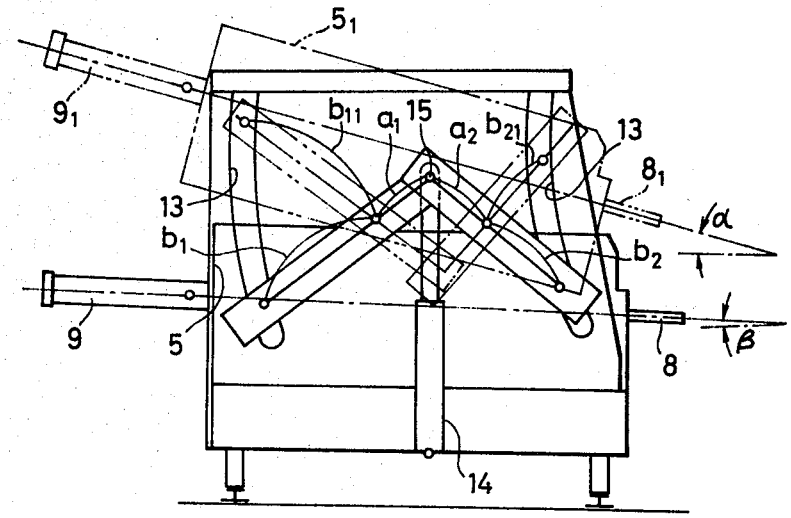
FIG. 4 is a side view for a description of the operation of a link drive device employed in the mechanical puncher of FIG. 3.

The distances $b_1$ and $b_2$ between one of the supporting shafts and one of the holding shafts and between the other supporting shaft and the other holding shaft, respectively, can be changed to values $b_{11}$ and $b_{21}$. The distance $b_1$ is longer than the distance $b_2$ as shown in FIG. 4. Therefore, the angle of inclination of the punching rod can be changed from $\beta$ to $\alpha$, the link operation of the link drive device 14 can be smoothly effected by employing a pin joint for the lower end of the link drive device 14.

As is clear from the above description, according to the invention, the punching rods can be suitably positioned with only one operation of the link drive device 14 with respect to the three essential variable factor of the tuyere, that is, the degree of inclination and the vertical and horizontal positions of the tuyere which are changed according to operational requirements of the converter. Moreover, the time required for positioning the punching rods is reduced while a high accuracy in directing the punching rod to the aimed tuyere is provided. In combination with the position detecting means 16, the mechanical punching device of the invention can be fully automatically operated.

What is claimed is:

1. A mechanical punching device for punching the tuyeres of a converter comprising: a mechanical puncher mounted on a movable carriage, said puncher positioned between two confronting side walls each of which is provided with a link mechanism, holding shafts extending through guide grooves in each corresponding side wall, and a punching rod driving cylinder, said link mechanism comprising two supporting shafts coupled to each corresponding side wall, two turning arms each of which has a bearing slot on each end portion and which is pivotally coupled at a point between the bearing slots to each of said two supporting shafts, link drive means having an end shaft, said two turning arms being coupled to each other through said bearing slots formed in first end portions thereof by said end shaft of said link drive means, said bearing slots formed in second end portions of said two turning arms being coupled to said holding shafts of said mechanical puncher which extend through guide grooves formed in said side wall.

2. The device as claimed in claim 1 wherein a distance between the axis of one of said supporting shafts on said side wall of said carriage and the axis of one of said holding shafts of said mechanical puncher on the side of punching rods is shorter than a distance between the axis of the other supporting shaft and the axis of the other holding shaft on the side of said punching rod driving cylinder.

3. The device as claimed in claim 1 or 2 wherein said guide grooves formed in said side wall of said carriage are inclined towards said punching rod driving cylinder, and each having arcuate curve concentrical with said converter.

4. The device as claimed in claim 1 or 2 wherein said mechanical puncher comprises two punching rod driving cylinders and two punching rods coupled to each of said punching rod driving cylinders.

* * * * *